US008397470B2

(12) United States Patent
Summons et al.

(10) Patent No.: US 8,397,470 B2
(45) Date of Patent: Mar. 19, 2013

(54) SYSTEM AND METHOD OF SECURING ROOFING COMPONENTS WITH ONE ANOTHER

(75) Inventors: Wayne Summons, Thornton, CO (US); Elliot Summons, Centennial, CO (US)

(73) Assignee: Sashco, Inc., Brighton, CO (US)

( * ) Notice: Subject to any disclaimer, the term of this patent is extended or adjusted under 35 U.S.C. 154(b) by 0 days.

(21) Appl. No.: 12/978,029

(22) Filed: Dec. 23, 2010

(65) Prior Publication Data

US 2012/0159892 A1 Jun. 28, 2012

(51) Int. Cl.
*E04B 7/00* (2006.01)
*E04B 1/00* (2006.01)

(52) U.S. Cl. ..... 52/746.11; 52/92.2; 52/93.1; 52/272; 52/698; 52/700

(58) Field of Classification Search ..... 52/92.2, 52/93.1, 272, 282.4, 474, 285.1, 289, 483.1, 52/489.1, 506.01, 282.3, 506.05, 512, 698, 52/699, 700, 702, 703, 704, 708, 712, 714, 52/715, 846; 248/300; 30/282, 286, 289; 33/628, 630, 633
See application file for complete search history.

(56) References Cited

U.S. PATENT DOCUMENTS

| | | | | | |
|---|---|---|---|---|---|
| 939,005 | A * | 11/1909 | Goedeke | 217/69 |
| 1,346,955 | A * | 7/1920 | Gustafson | 248/188 |
| 3,601,428 | A * | 8/1971 | Gilb | 403/232.1 |
| 4,284,213 | A * | 8/1981 | Lee | 222/541.2 |
| 4,738,071 | A * | 4/1988 | Ezard | 52/745.19 |
| 5,881,899 | A * | 3/1999 | Suzuki et al. | 220/319 |
| 7,134,252 | B2 * | 11/2006 | Thompson | 52/712 |
| 7,418,785 | B2 * | 9/2008 | Whitemiller et al. | 30/182 |
| 7,997,039 | B2 * | 8/2011 | Wolf et al. | 52/314 |

* cited by examiner

*Primary Examiner* — William Gilbert
*Assistant Examiner* — Patrick Maestri
(74) *Attorney, Agent, or Firm* — Holland & Hart LLP

(57) ABSTRACT

An angled bracket having first and second opposing, generally planar sections is positioned so that protrusions extending from the first planar section engage a portion of roof sheathing and the second planar section is positioned against a rafter. Mechanical fasteners may secure the second planar section to the rafter. Adhesive is disposed through fill apertures in the first planar section until a layer of adhesive is formed between the bracket and the sheathing. A second angular section may extend from the opposite side of the bracket, enabling the bracket to sandwich the rafter. Gussets may be used to brace the first and second planar sections. Indicator apertures allow a user to ensure the layer of adhesive substantially covers the first planar section.

22 Claims, 16 Drawing Sheets

50
14
14
12

SYSTEM AND METHOD OF SECURING ROOFING COMPONENTS WITH ONE ANOTHER

BACKGROUND

Hurricanes, tornadoes, and other severe wind events are responsible for damaging or destroying thousands of residential and light commercial buildings around the world every year. The wind, during severe winds, flows across a roof causing negative pressures that create a lifting force on the roof structure. This is one of the most common ways that homes or other buildings are destroyed during severe weather. This is due, in part, to inadequate construction methods. It is well known that many homes built in recent decades have roof sheathing that is poorly attached to the supporting wood trusses or rafters because of poor quality installation of nails or staples, with many such nails or staples completely missing their mark and completely failing to fasten these critical roofing elements solidly together. Similarly, roof trusses are oftentimes simply toe nailed into the top of the adjoining walls. However, nails provide little structural advantage during a severe wind event. Traditional homebuilding relies on gravity and friction to keep a roof in place. During severe weather events, however, gravity alone becomes insufficient to prevent the roof from peeling off the rest of the building. Once this occurs, the building is fatally weakened and collapses.

Various products have been developed that attempt to anchor the roof to the walls. In some instances, metal straps are nailed into the wall and wrapped over the trusses. In other instances, temporary straps made from a special low-elongation material have been secured to roof structures and the foundations of homes and other buildings which enhance structural stability. However, hurricane harness strapping requires that the system be manually applied prior to a storm to be effective. This may be impractical where the structure is a vacation home or inhabited by elderly or disabled persons.

A variety of other methods have been developed to increase the structural integrity of buildings so that the buildings are more likely to survive strong winds and storm surges. Considerable attention has been given to strengthening the building codes in such areas as Dade County Florida to mandate constructing new structures with greater resistance to wind loads, and some effort has been put into retrofitting existing structures to better withstand these wind forces. However, the retrofit approaches taken so far are not very good at solving this critical need—either because of poor concepts using adhesives that are likely to fail when buildings are severely stressed in a strong storm event or because otherwise effective concepts (such as spray adhesive/foams) are so expensive, dangerous or cumbersome to install by building owners who might otherwise use them. One aspect of the present technology is aimed specifically at the problem of better securing roof sheathing to rafters and trusses and better sealing the entire roof system against moisture intrusion, and doing so in a way that is less dangerous, less costly, requiring little or no specialized equipment and training, highly effective and reliable, and more readily doable by all contractors and even homeowners themselves.

The Foamseal Hurricane Adhesive, from ITW Devcon Company, is representative of the 2-component spray polyurethane foam products currently being used in the trade. These products are sprayed, while working in the attic, onto the underside of the joints between the 4'×8' plywood or OSB sheathing and the wood rafters or trusses and onto the underside of the built-in ⅛"-¼" gaps between the sheathing sheets themselves. These initially liquid products immediately begin to cure as they are applied and become a rigid foam, with high tensile strength, in a matter of minutes. When cured, they are strong and establish good adhesion to the wood components they contact. These cured polyurethane foams reportedly increase the uplift strength of roof sheathing in high winds by 2½ to 3 times and help to seal the built-in joints between plywood sheathing to prevent most or all rainwater from entering the structure when the shingles and tar paper are blown off the roof surface, which typically happens in a hurricane. These 2-component, highly-reactive foam products must be applied by specially-trained contractors using very specialized 2-component equipment, at a cost of many thousands of dollars per home or business. The contractors who do this work must wear protective clothing and chemical respirators to prevent being injured from the fumes (especially any isocyanates released from the chemical reaction making the foam) from the spraying process that might otherwise enter their lungs or eyes and contact their skin. Moreover, working in such protective clothing in the confines of a hot attic can be very physically demanding for anyone who does this work. Also, the companies that provide these chemicals and apply them to roofing structures claim that there is no danger from the chemicals. However, exposure to the chemicals and their resulting foam is likely not safe until all of the fumes have fully dissipated. In some instances, it could take days or weeks for the dangerous fumes to dissipate, all the while exposing the residents of the home.

Alternative methods to the spray adhesive/foam systems have been developed that are easier, cheaper, and less dangerous to apply. One such approach to retrofitting existing roofs involves the application of a fillet bead of construction adhesive to the right-angle joint where 4'×8' sheets of sheathing contact the supporting rafters or trusses. While applying such a fillet bead of adhesive is relatively simple, quick, and inexpensive, the true effectiveness of this technique is highly doubtful, especially after such a fillet bead is stressed during the expansion and contraction of the roofing elements as they heat and cool, each day, over long periods of time. When an adhesive, even an adhesive that is somewhat flexible, is applied in a joint such as the sheathing/rafter right-angle joint, such a joint design, as is technically well-known in the industry, does not properly dissipate the powerful tensile and shear forces at the bond-line between the adhesive and wood to avoid inducing either premature adhesive, cohesive or substrate failure or weakening when normal expansion/contraction repeatedly occurs over many years from everyday cooling and heating. If such adhesive failure or weakening occurs, then when a high-wind event finally does happen, then the failed or weakened adhesive is not capable of providing the uplift resistance needed when needed most.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

A system is provided, according to the present technology, for securing roof trusses or rafters with portions of roof sheathing. The system includes a bracket having a first generally planar section and a second generally planar section that are perpendicularly oriented with respect to one another. A plurality of laterally spaced protrusions extend outwardly from a first surface of the first planar section, which faces away from the second planar section. A plurality of laterally spaced adhesive fill apertures penetrate the first planar section. A plurality of laterally spaced fastener apertures penetrate the second planar section.

In at least one method of use, the bracket is positioned so that the protrusions extending from the first planar section engage a portion of sheathing and the second planar section is positioned against the side of a rafter. A plurality of mechanical fasteners are at least partially passed through one or more of the fastener apertures of the second planar section and into the rafter. In this position, a majority of the first planar section, except for the protrusions, will be placed in a spaced-apart relationship with the sheathing. A volume of adhesive may then be passed through at least one of the plurality of adhesive fill apertures in the first planar section, such that a layer of adhesive is formed between the sheathing and the first surface of the first planar section of the bracket. To ensure that the layer of adhesive comes into contact with substantially all of the first planar section, a plurality of laterally spaced indicator apertures may be formed to penetrate the first planar section. In this manner, a user may be provided with visual indications across the length of the bracket that the adhesive has optimally covered the first planar section without a significant volume of adhesive escaping from the indicator apertures.

The system may be employed using a standard adhesive dispensing cartridge, having an enclosed nozzle that needs to be opened by cutting away a distal end portion of the nozzle. In such instances, a cutting guide may be provided to help the user cut a standard plastic adhesive nozzle to the proper diameter for snugly fitting into the adhesive fill apertures. In some embodiments, the cutting guide is open at both ends and is slipped over the narrow end of the nozzle until it bottoms out. With the cutting guide in position around the nozzle, the tip of the nozzle may be removed from the nozzle with a knife.

One embodiment of the bracket includes one or more gussets that extend from the second planar section and are coupled with the first planar section. In this manner, distal edge portions of the first planar section and second planar section resist movement toward or away from one another. In at least one embodiment, a pair of gussets are disposed at opposite end portions of the bracket.

Various embodiments of the bracket include a pointed projection that is formed into the center of the leading edge of the first planar section. The projection may be used for locating the joint between sheets of roof sheathing by feel, if necessary, by moving the point of the projection across a portion of the roof sheathing until the projection engages the joint. The bracket may then be rotated into a mounting position against a rafter.

An alternate, double bracket may be provided with a pair of first generally planar sections, disposed in a co-planar, laterally spaced-apart relationship with one another. The double bracket will include a U-shaped center section that includes a pair of a second generally planar sections that are positioned to be in a generally parallel, spaced-apart relationship with one another. The U-shaped center section further includes a connector section that extends between distal end portions of the second planar sections. A plurality of laterally spaced protrusions extend outwardly from a first surface of the first planar sections. A plurality of laterally spaced fill apertures and indicator apertures penetrate the first planar sections. A plurality of laterally spaced fastener apertures penetrate the second planar sections. Some embodiments of the double bracket include a plurality of barbed tabs that are formed in the second planar sections of the U-shaped center section. Distal points of the barbed tabs are oriented at an angle toward the connector section to permit the user to push or pound the double bracket onto a rafter or truss so that the double bracket will be temporarily secured in place by the barbed tabs while the user prepares to drive mechanical fasteners through the fastener apertures.

A self-nailing support arm may be provided to extend from any of the brackets. In some embodiments, the support arm extends from the second planar section such that a first portion of the support arm is positioned against the side of a rafter, and a second portion is positioned against the bottom edge of the rafter, when the bracket is in a mounting position. The second portion of the support arm is provided with one or more speed prongs that are positioned to extend away from the support arm at an angle, such that they may be struck with a hammer to set the speed prongs into the rafter and support the bracket until it may be secured with mechanical fasteners and adhesive.

The present technology increases the strength of existing residential and light commercial building roofs against the damaging effects of high winds, such as those experienced during hurricanes; tornadoes, and torrential rains. The technology may be used to retrofit the millions of existing homes in locations throughout the world that are subject to severe weather. However, the present technology may also be used during new construction.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

Figure 16A:
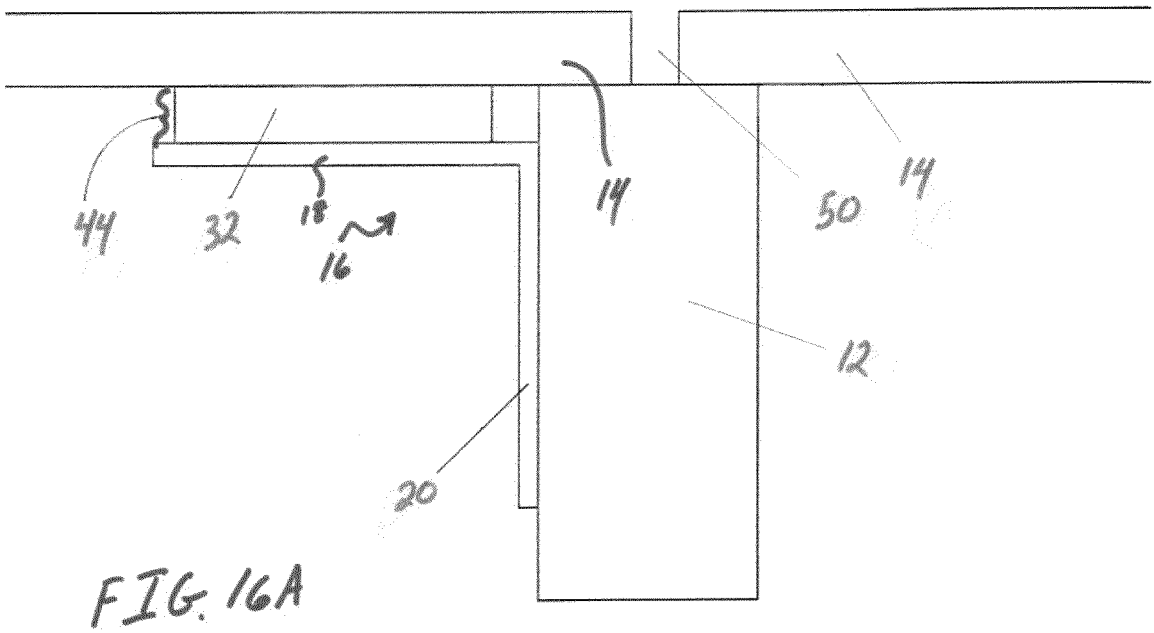

FIG. 16A depicts a side elevation view of one embodiment of a bracket, according to the present technology, and further depicts one manner in which the bracket may be coupled by a flexible adhesive with a rafter and a portion of one sheet of roof sheathing. This view clearly illustrates the relatively large spacing gap, where the flexible adhesive is placed, which is required in order to minimize shear forces on the parallel bond-lines of the adhesive when the roof sheathing expands and contracts over time.

Figure 16B:
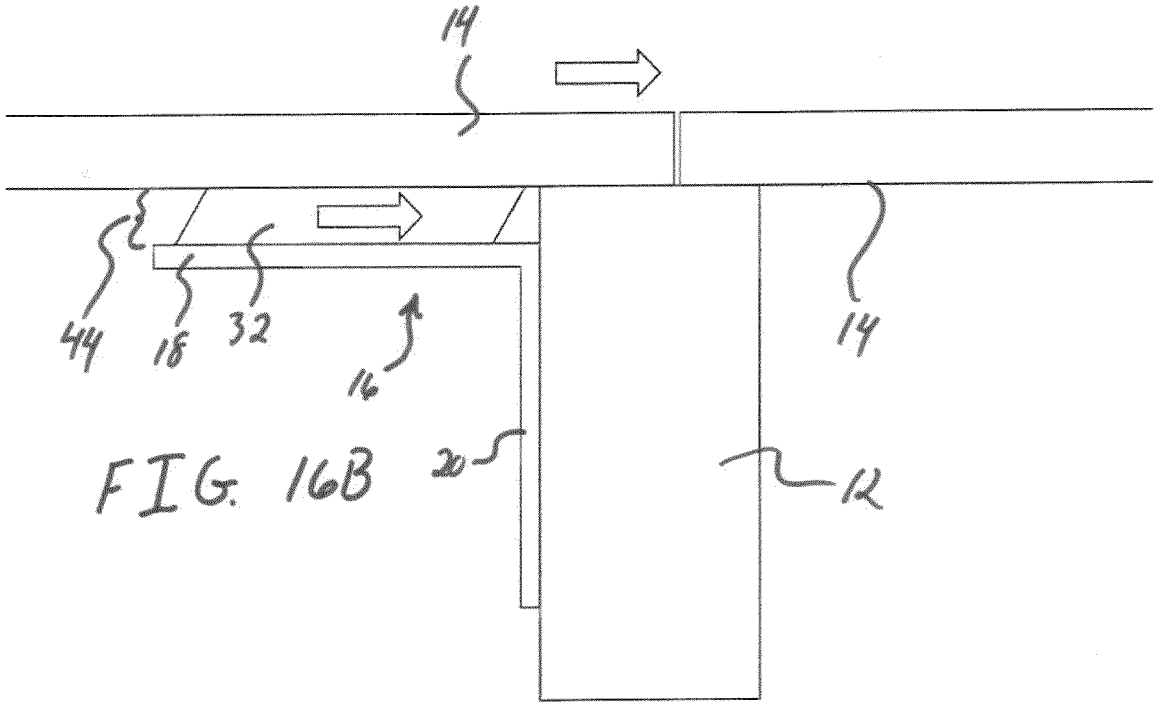

FIG. 16B depicts the bracket and roofing components depicted in FIG. 16A and further depicts one manner in which the sheet of roof sheathing may move with respect to the rafter, toward another sheet of roof sheathing, in a manner that flexes but does not shear a layer of adhesive between the bracket and the sheet of roof sheathing.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

With reference to FIGS. 1-16, a system 10 is provided, for securing rafters 12 with portions of roof sheathing 14. The system 10 includes a bracket 16 having a first generally planar section 18 and a second generally planar section 20 that are perpendicularly oriented with respect to one another. In at least one embodiment, the bracket 16 is formed using uniform construction, whereby the bracket 16 is bent at an angle, between the first planar section 18 and second planar section 20. The angle, in many embodiments, will be at or approximating ninety degrees. In some embodiments, the bracket 16 is formed from galvanized steel. However, other materials known in the construction arts, including other metals, polymers, and the like, are contemplated. The material from which the bracket 16 is formed will be of sufficient thickness or gauge to provide the structural strength required by the anticipated application. Accordingly, a range of gauges is contemplated. A plurality of laterally spaced protrusions 22 extend outwardly from a first surface 24 of the first planar section 18, which faces away from the second planar section 20. A plurality of laterally spaced adhesive fill apertures 26 penetrate the first planar section 18. A plurality of laterally spaced fastener apertures 28 penetrate the second planar section 18. Various embodiments of the brackets 16 will be provided in various lengths, such as one, two, three, or four feet. Similarly, various embodiments may have first planar sections 18 and second planar sections of widths of one to four inches. However, greater widths are contemplated for larger brackets 16.

Figure 2:
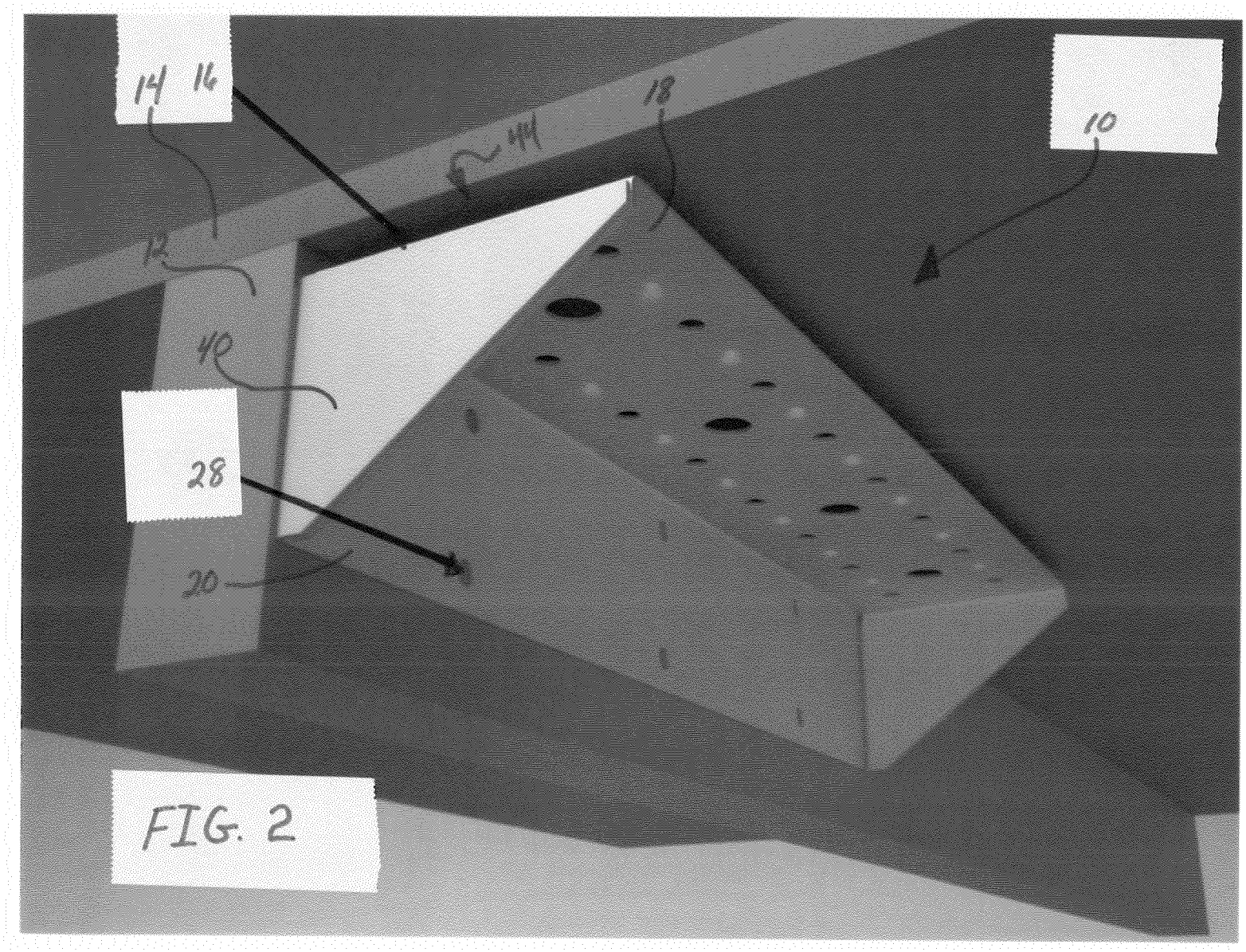
FIG. 2 depicts a lower perspective view of the bracket depicted in FIG. 1 and depicts one manner in which such a bracket may be positioned against a rafter and a portion of roof sheathing.
Figure 3:
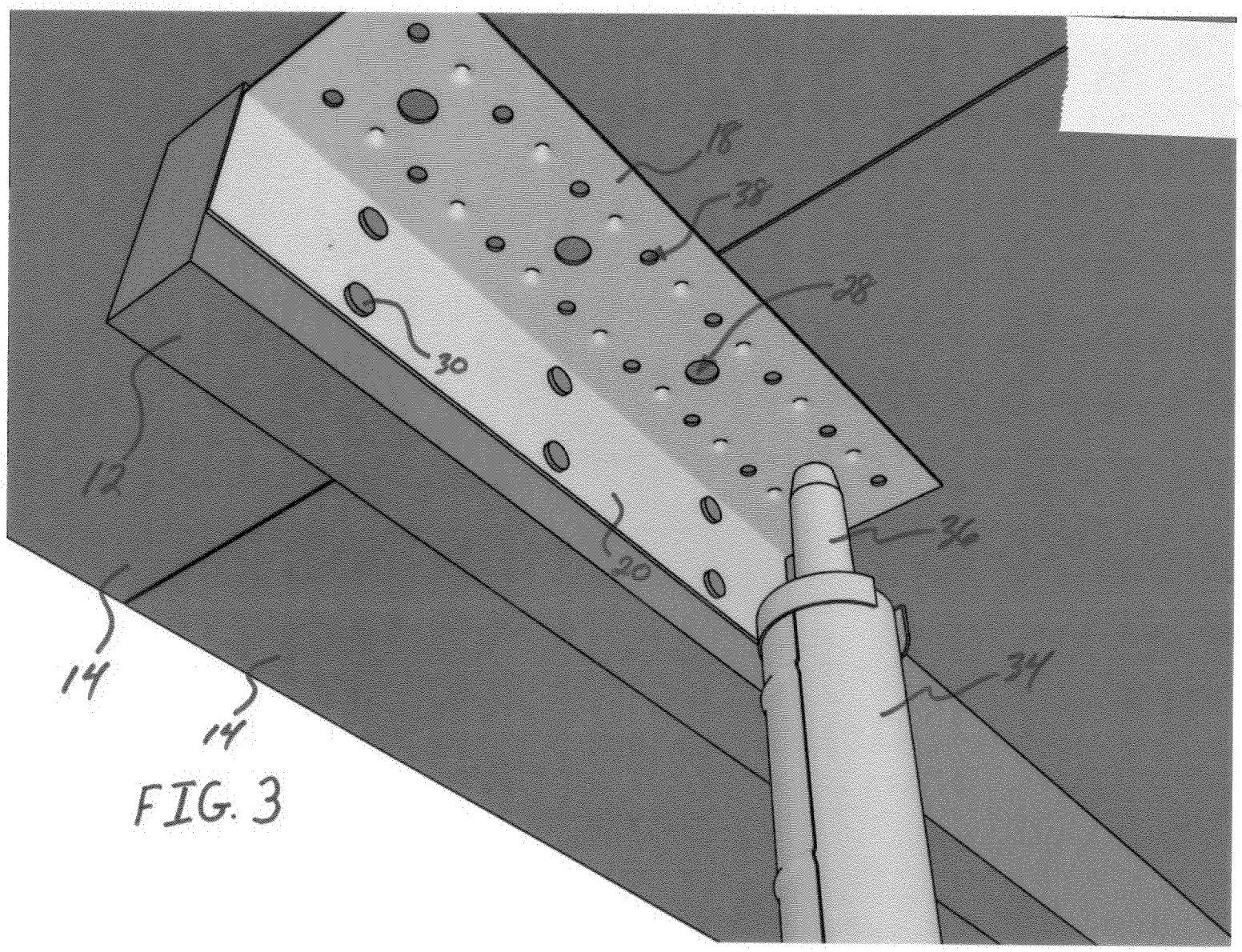
FIG. 3 depicts a lower perspective view of another embodiment of a bracket, according to the present technology, depicting one manner in which such a bracket may be secured with a rafter and portions of roof sheathing.

With reference to FIG. 2, in at least one method of use, the bracket 16 is positioned so that the protrusions 22 extending from the first planar section 18 engage a portion of sheathing 14 and the second planar section 20 is positioned against the side of a rafter 12. With reference to FIG. 3, a plurality of mechanical fasteners 30 are at least partially through one or more of the fastener apertures 28 and into the rafter 12. It is contemplated that the mechanical fastener may include a nail or screw of various sizes and styles, such as those commonly used in the construction industry. In this position, a majority of the first planar section 18, except for the protrusions 22, will be placed in a spaced-apart relationship with the sheathing 14. In some embodiments, this space may range from between 1/16" to 1".

Figure 4:
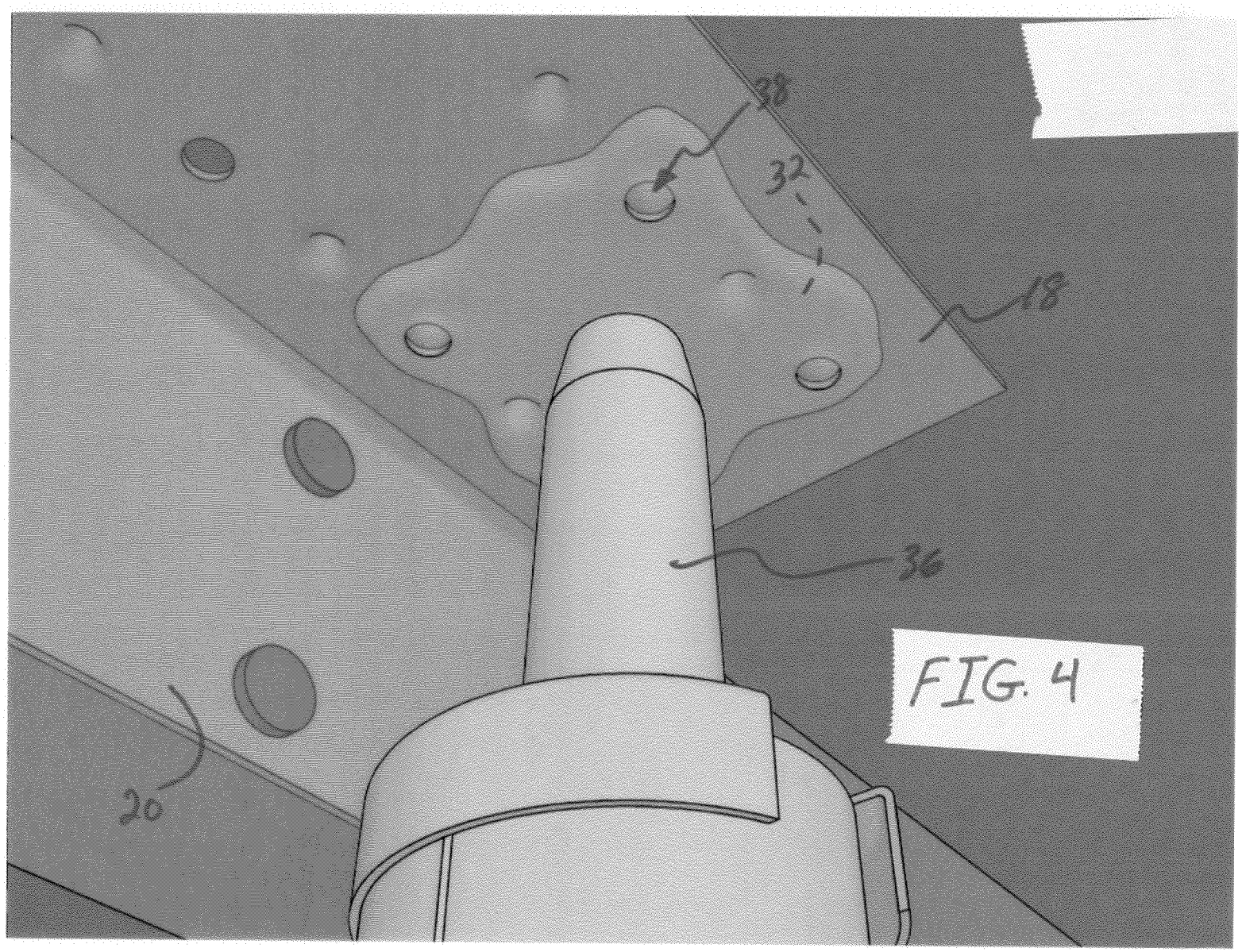
FIG. 4 depicts an isometric view of the bracket depicted in FIG. 3 and further depicts one manner in which adhesives may be disposed between the bracket and a portion of roof sheathing.
Figure 5:
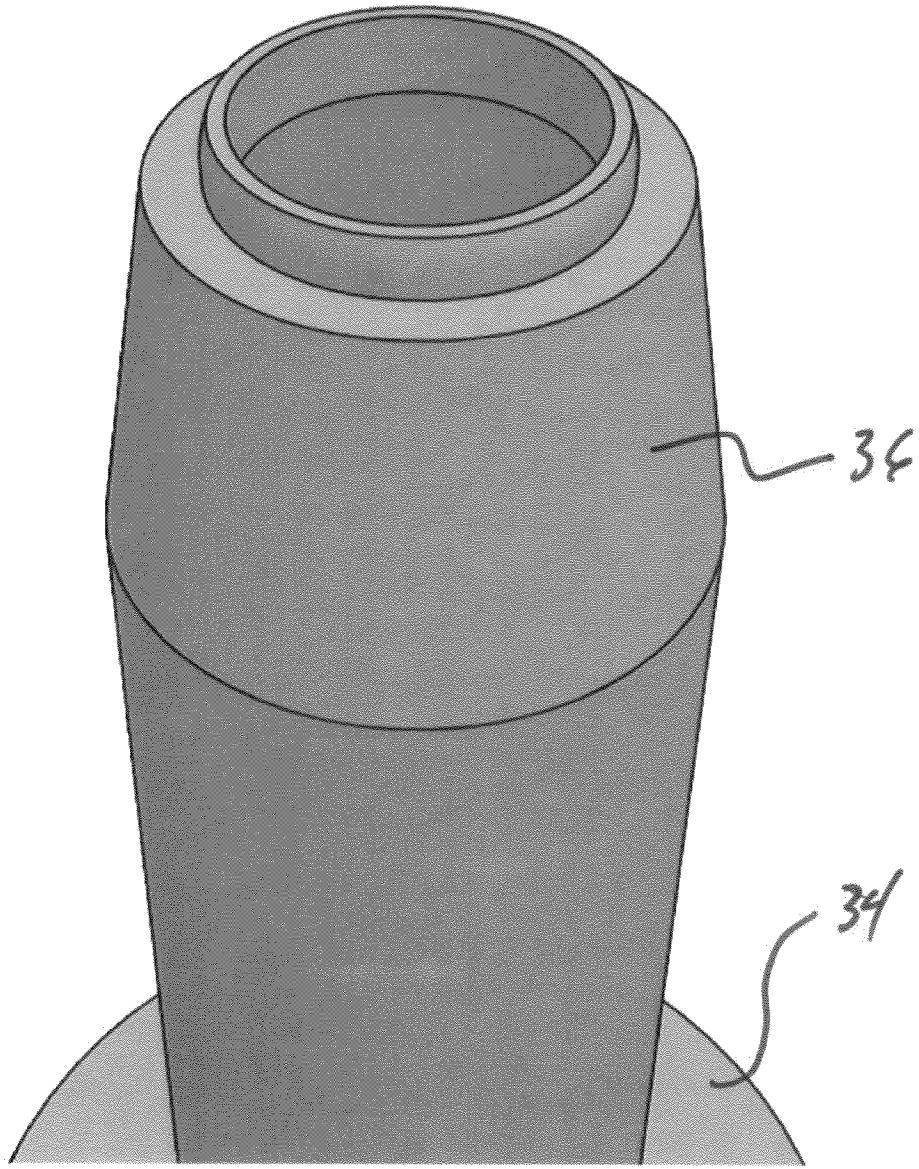
FIG. 5 depicts an isometric view of one embodiment of a tip to an adhesive dispensing cartridge that provides a leak-tight engagement with the adhesive filling aperture.

With reference to FIGS. 3 and 4, a volume of adhesive 32 may then be passed through at least one of the plurality of fill apertures 26 in the first planar section 18, such that a layer of adhesive 32 is formed between the sheathing 14 and the first surface 24 of the first planar section 18 of the bracket 16. This may be accomplished by using an adhesive dispensing gun similar to a caulking gun using a dispensing cartridge 34 with a nozzle 36. In this manner, the adhesive fill apertures 26 will be sized to accommodate the nozzle 36. In some embodiments, the adhesive fill apertures 26 are sized to optimally allow a properly cut or molded nozzle 36 to enter the adhesive fill apertures 26 without contacting the sheathing 14. With reference to FIG. 5, various embodiments of the system 10, may include a nozzle 36 for a dispensing cartridge 34 that is pre-molded to closely approximate the dimensions of the adhesive fill apertures 26. In some embodiments, an annular collar 37 is formed to extend from a distal end portion of the nozzle 36 that forms a socket that fits just within the dimensions of the adhesive fill apertures 26. Accordingly, a snug fit between the nozzle 36 and the adhesive fill apertures 26 can be easily attained and little or no back-flow is experienced as the adhesive is injected between the bracket 16 and the sheet of roof sheathing 14. This shape of nozzle 36 will further prevent the nozzle from passing too far through the first planar section 18 and "bottoming-out" against the sheet of roof sheathing 14.

Figure 6:
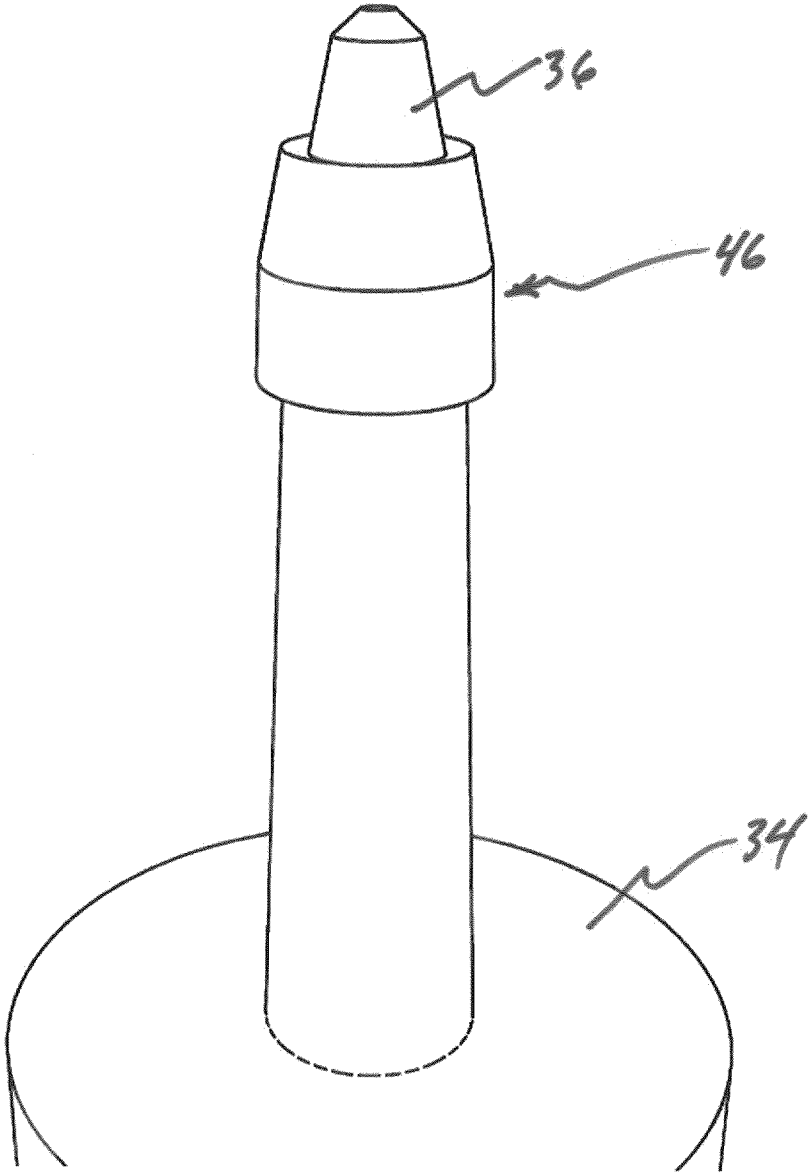
FIG. 6 depicts an isometric view of one embodiment of a cutting guide that may be used with an adhesive dispensing cartridge and further depicts one manner in which the cutting guide may be coupled with a tip of the adhesive dispensing cartridge prior to cutting the tip.
Figure 7:
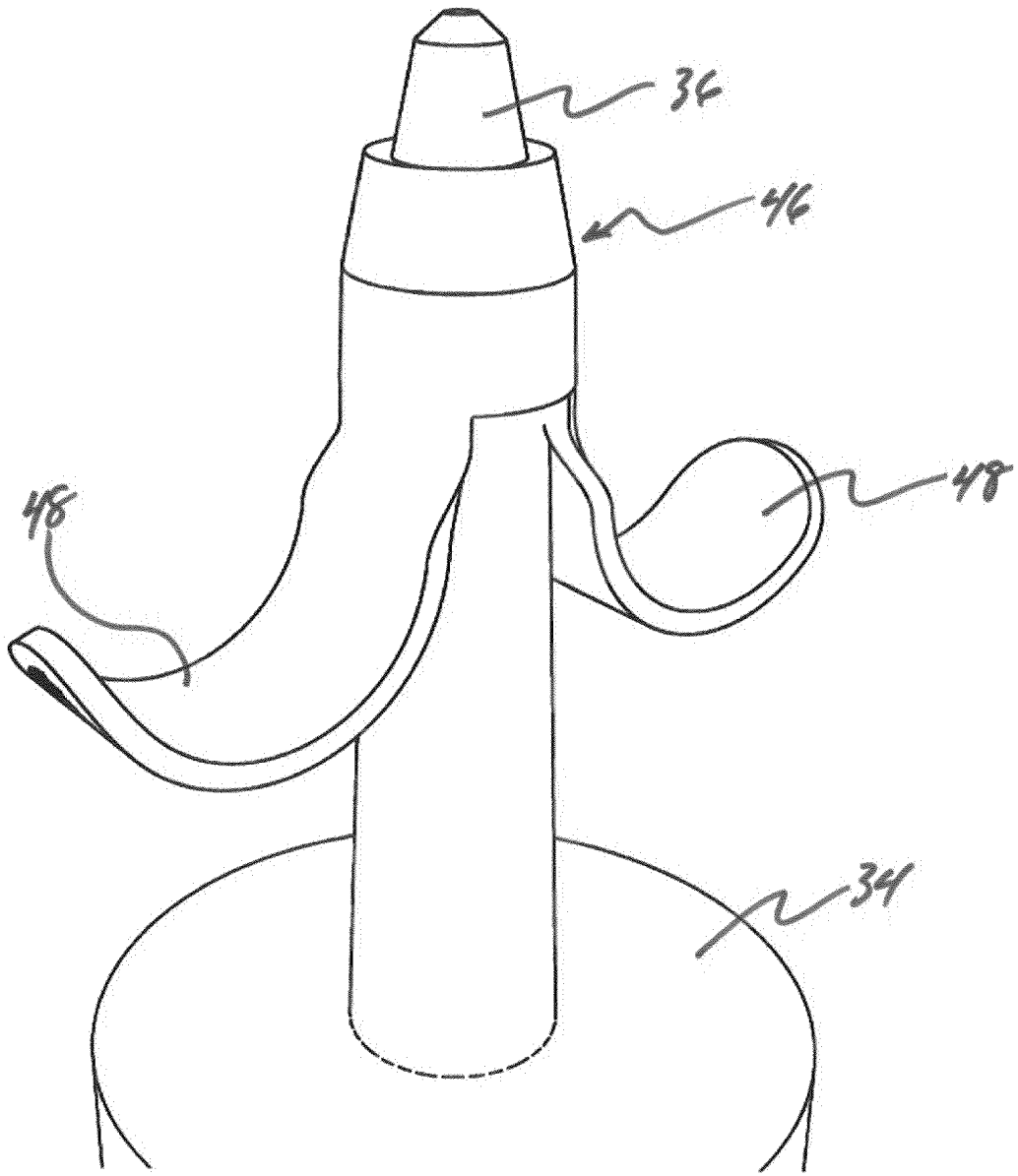
FIG. 7 depicts an isometric view of another embodiment of a cutting guide that may be used with an adhesive dispensing cartridge and further depicts one manner in which the cutting guide may be coupled with a tip of the adhesive dispensing cartridge prior to cutting the tip.
Figure 8:
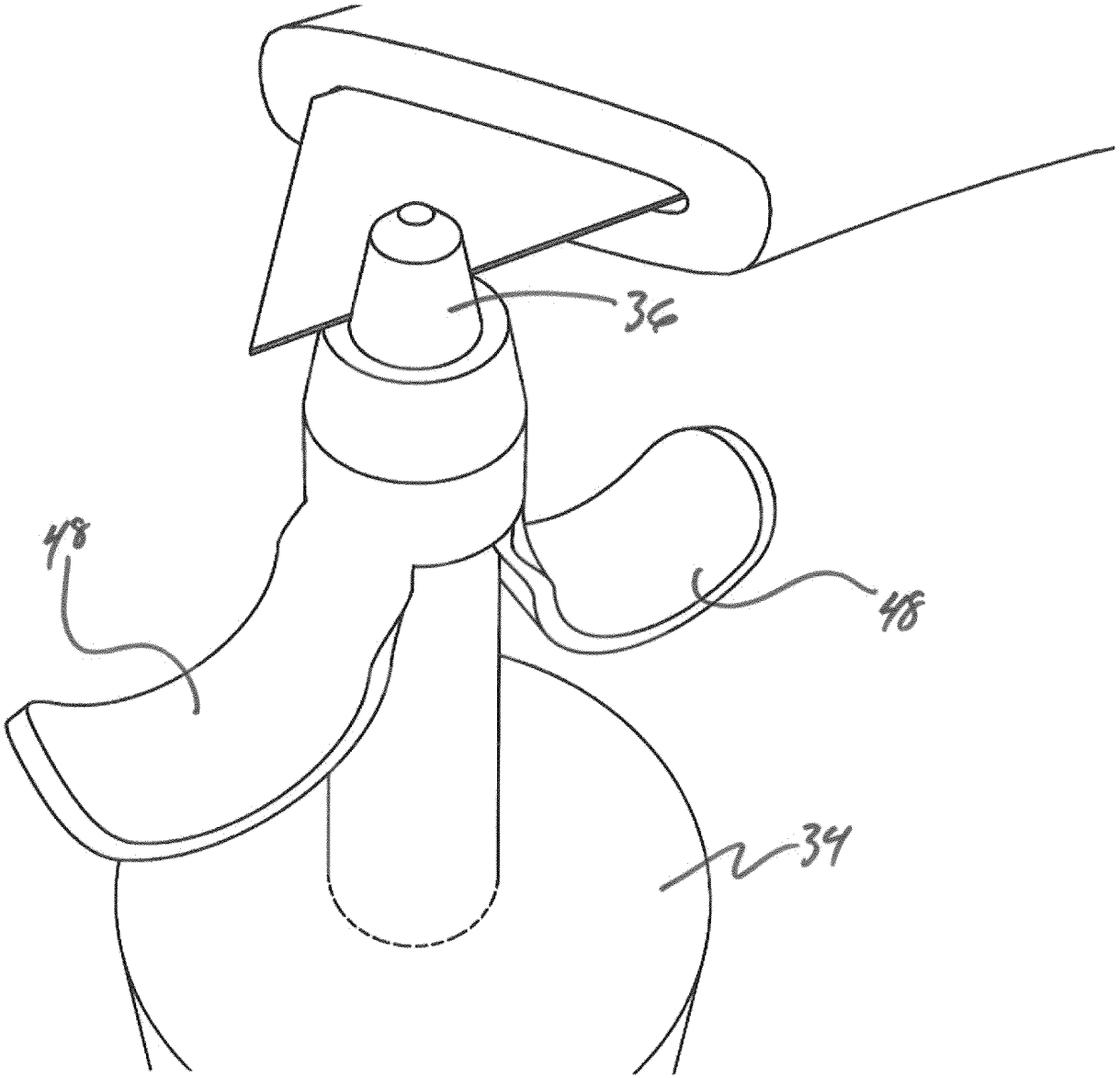
FIG. 8 depicts an isometric view of the cutting guide and adhesive dispensing cartridge depicted in FIG. 7 and further depicts one manner in which a portion of the tip may be cut from the adhesive dispensing cartridge.

With reference to FIGS. 6-8, it is contemplated that the system 10 may be employed using a standard adhesive dispensing cartridge 34, having an enclosed nozzle 36 that needs to be opened by cutting away a distal end portion of the nozzle 36. In such instances, a cutting guide 46 may be provided to help the user cut a standard plastic adhesive nozzle to the proper diameter for snugly fitting into the adhesive fill apertures 26. It is contemplated that the cutting guide 46 could be made of various materials, such as metal, plastic or the like. In some embodiments, the cutting guide 46 is open at both ends and is slipped over the narrow end of the nozzle 36 until it bottoms out. The two open ends of the cutting guide 46 may be differently sized so that the cutting guide 46 may be disposed onto a nozzle 36 having a tapered shape. With reference to FIG. 7, various embodiments of the cutting guide 46 may be provided with a pair of opposing support arms 48 that extend outwardly from the sides of the cutting guide 46. In some embodiments, the support arms may be slightly curved as they project radially from the cutting guide 46 to enable the user to firmly, but comfortably, hold the cutting guide 46 in place while cutting the tip of the nozzle 36 from the dispensing cartridge 34. With the cutting guide 46 in position around the nozzle 36, the tip of the nozzle 36 may be removed from the nozzle 36 with a knife, as depicted in FIG. 8, at the intersection of the nozzle 36 and the end of the cutting guide 46 with the smallest diameter opening.

With reference to FIG. 4, the first planar section 18 has been shown to be transparent so that the flow of the injected adhesive 32 can be seen. This demonstrates one manner how the adhesive 32 flows laterally from the adhesive fill aperture 26 as it, is injected into the pre-defined gap between the roof sheathing 14 and the bracket 16. As the adhesive 32 flows laterally, it will come into intimate contact with both the underside of the roof sheathing 14 and the upper surface 24 of the first planar section 18. If the adhesive 32 is, alternatively, formulated so that it will expand or foam upon application, such a formulated adhesive 32 will clearly have enhanced capability of fully contacting and wetting out the targeted surfaces for enhanced adhesion. When the adhesive 32 is seen by the user to show up at the indicator apertures 38, the user knows that a sufficient volume of adhesive 32 has been applied and the user can go to the next adhesive fill aperture 26 to repeat the process. In some embodiments, the first surface 24 of the first planar section 18 can be formed to have a texture (formed by conventional methods, such as sandblasting, chemical etching or the like) so as to create a bonding surface with more surface area on which the adhesive 32 may gain maximum adhesion to the bracket 16. Similarly, should it be desirable, a primer may be applied (by conventional methods) to the underside of the roof sheathing 14 to further enhance adhesion of the adhesive 32 to the roof sheathing 14.

It is contemplated that various types of sheathing 14 may be encountered using the present technology. For example, various forms of plywood, OSB (oriented strand board), and the like, are common in residential and light commercial buildings. Accordingly, examples of adhesive 32 that may be used with the present technology include, but are not limited to: modified silicone polymer sealant, and polyurethane and polysulfide-based adhesives. Other examples of adhesives 32 include rubber-type adhesives, such as various known water-home and solvent-borne adhesives. Any of the aforementioned adhesives, when properly formulated, can provide a reasonable amount of flexibility, once cured, in the bond between opposing structures. Such a characteristic will be desirable in many circumstances where, over years, roofing components and the structures to which they are secured may settle, expand, contract, and the like. An overly rigid adhesive 32 would inevitably lead to severe shear stress at both parallel bond-lines, as temperature changes cause the roof sheathing 14 to expand and contract over time, and such severe shear stress can potentially cause adhesive failure at said bond-lines. Consequently, the use of a relatively low modulus adhesive with relatively high elongation capability is required to insure that the adhesive will be fully intact both adhesively and cohesively should a powerful storm event eventually occur, which could be decades after the adhesive is initially installed.

Irrespective of the type of adhesive 32 used, it will be desirable to dispose a sufficient volume of adhesive 32 between the sheathing 14 and the first planar section 18 of the bracket so that the structures are secured with one another. Accordingly, to ensure that the layer of adhesive 32 comes into contact with substantially all of the first planar section 18, a plurality of laterally spaced indicator apertures 38 may be formed to penetrate the first planar section 18. In some embodiments, the plurality of indicator apertures 38 are laterally spaced from, and smaller than, the adhesive fill apertures 26. In this manner, a user may be provided with visual indications across the length of the bracket 16 that the adhesive 32 has evenly covered the first planar section 18 without a significant volume of adhesive 32 escaping from the indicator apertures 38. An example of this visual indication is depicted in FIG. 4. While many methods of using the present technology to install the brackets 16 prior to injecting the adhesive 32 between the bracket 32 and the sheathing 14, it is contemplated that an applicator may first apply a layer of adhesive 32 to the first surface 24 of the first planar section 18 and then install the bracket 16.

Figure 1:
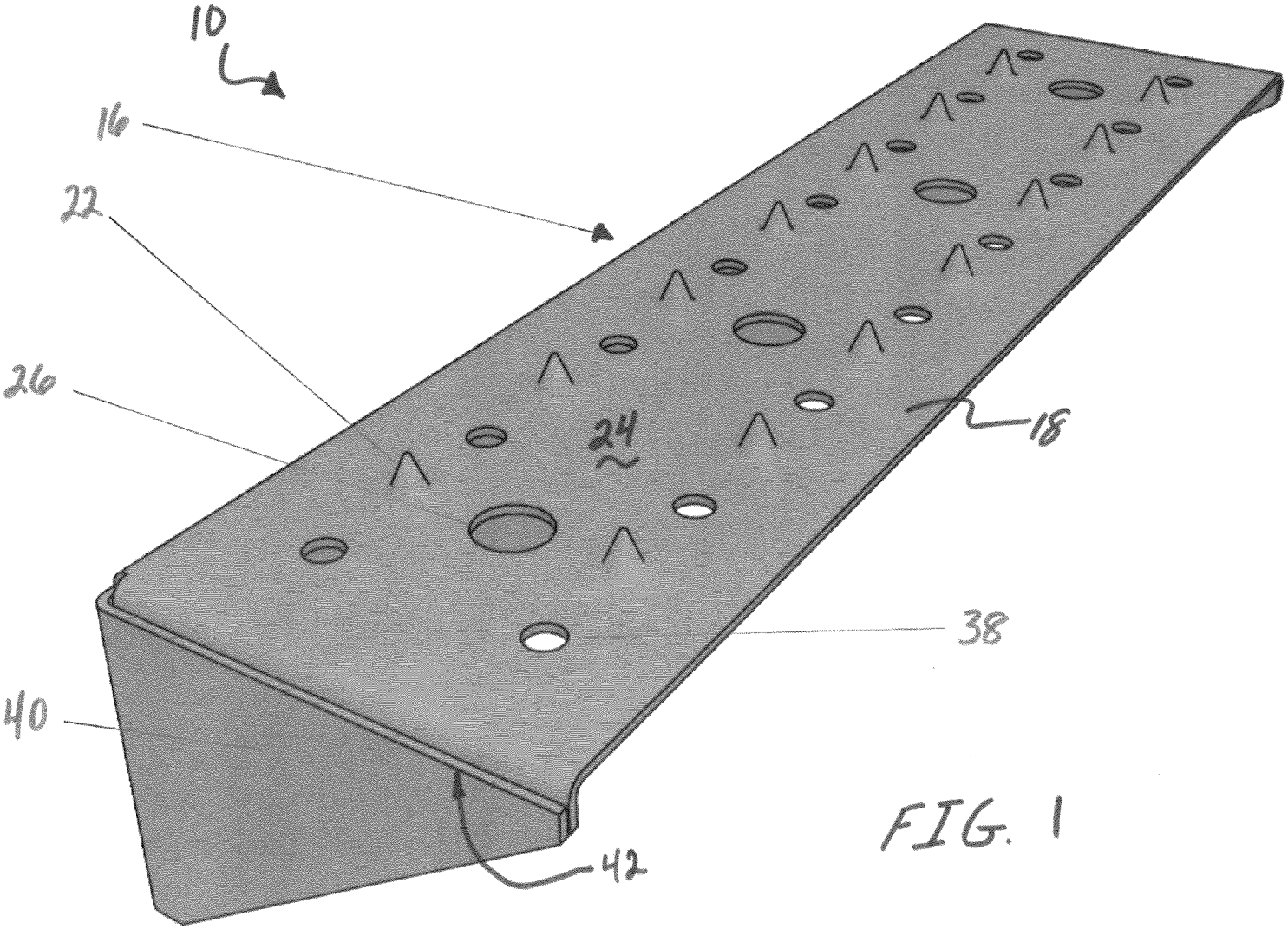
FIG. 1 depicts an upper perspective view of one embodiment of a bracket, according to the present technology, that may be used to secure roofing components with one another.

Uplift forces from high winds that are applied to the roof sheathing 14 are transferred by tensile forces first to the adhesive 32, then to the brackets 16, and finally to the rafters 12. With reference to FIGS. 1 and 2, one embodiment of the bracket 16 includes one or more gussets 40 that extend from the second planar section 20 and are coupled with the first planar section 18. In this manner, distal edge portions of the first planar section 18 and second planar section 20 resist movement toward one another. In some embodiments, the gussets 40 are formed in unitary construction with, and simply folded away from, the second planar section 20. A distal edge portion 42 of the gusset 40 may be connected to the first planar section 18, such as by spot welding or other techniques. In at least one embodiment, a pair of gussets are disposed at opposite end portions of the bracket 16. Where desired, one or more gussets 40 may be disposed intermediate the end portions of the bracket 16 to help resist any bending tendencies of the bracket 16, especially if a lighter gauge steel were to be used to form the bracket 16.

With reference to FIG. 2, various embodiments of the system 10 will provide a gap 44, that is created between the first planar section 18 and a sheet of roof sheathing 14 when the bracket 16 is placed in a use position. The size of the gap 44 will be defined in many embodiments by the size of the protrusions 22 extending from the first planar section 18. In various embodiments, the gap 44 helps the layer of adhesive 32 to function optimally. The gap 44 enables the layer of adhesive 32 to exhibit the visco-elastic capability of properly dissipating, at the bond line between the bracket 16 and the layer of adhesive 32 and the bond line between the layer of adhesive 32 and the sheet of roof sheathing 14, the expansion and contraction forces that inevitably occur when the roof components heat and cool over time. Accordingly, undue shear and other forces are not applied to these bond lines over the years, which could otherwise cause adhesive failure or weakening. In some embodiments, the width of the gap 44 formed between the sheet of roof sheathing 14 and the first planar section 18 will be between about 1/16" to about 1".

Figure 9:
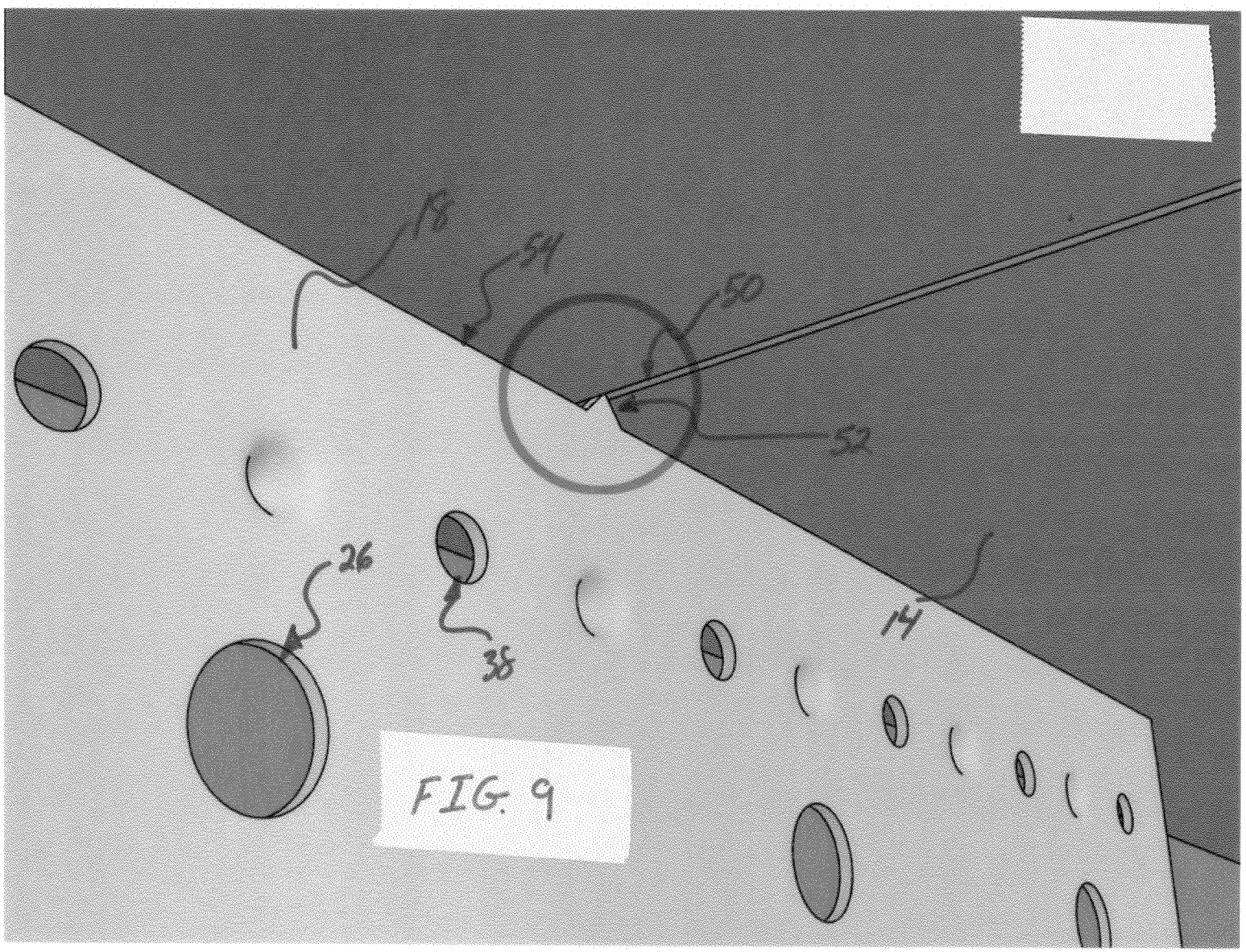
FIG. 9 depicts an isometric view of a portion of still another embodiment of the bracket, according to the present technology, and depicts one manner in which the bracket may be located with respect to a joint between sheets of roof sheathing.
Figure 10:
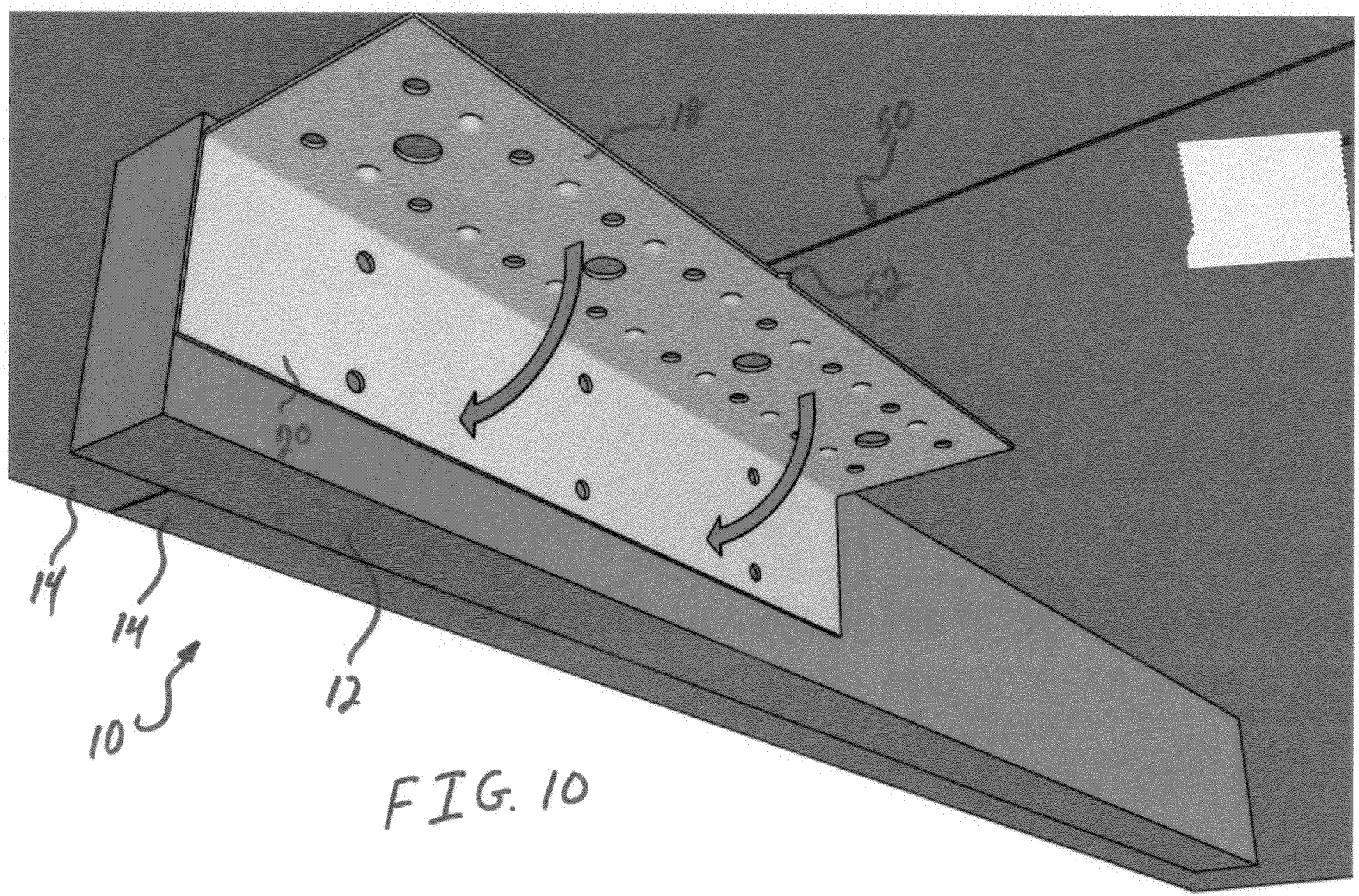
FIG. 10 depicts a perspective view of the bracket depicted in FIG. 5 and depicts one manner in which the bracket may be rotated into a mourning position with respect to a rafter and two sheets of roof sheathing.

It may be desirable to position the bracket 16 such that it is secured with two abutting sheets of roof sheathing 14. In such instances, the bracket may be centered on a joint 50 between the two sheets of roof sheathing. With reference to FIGS. 9 and 10, various embodiments of the bracket 16 include a pointed projection 52 that is formed into the center of the leading edge 54 of the first planar section 18. The projection 52 may be used for locating the joint 50 between sheets of roof sheathing 14 by feel, if necessary, by moving the point of the projection across a portion of the roof sheathing 14 until the projection 52 engages the joint 50. As demonstrated in FIG. 10, the bracket 16 may then be rotated into a mounting position against a rafter 12.

Figure 11:
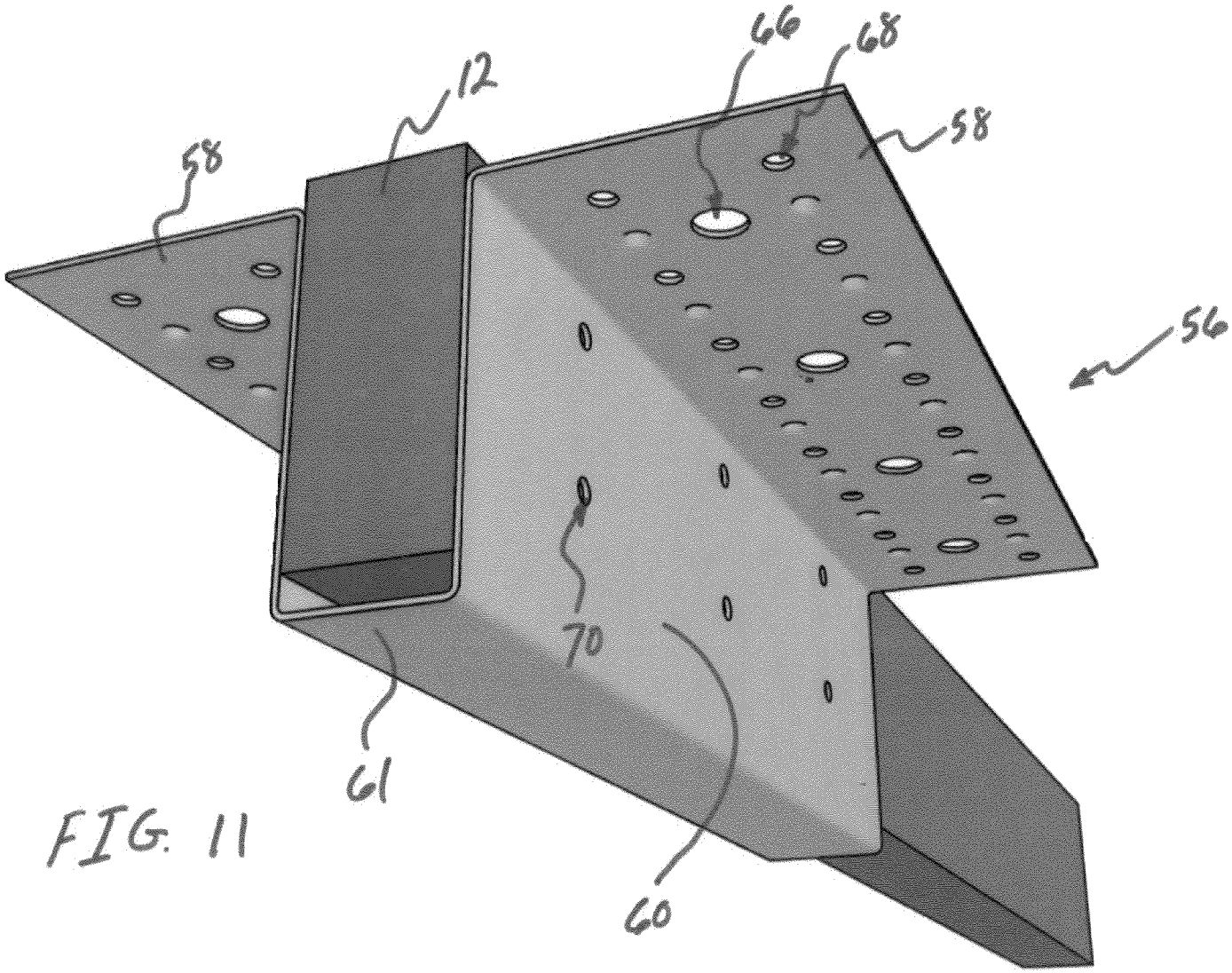
FIG. 11 depicts a lower perspective view of yet another embodiment of a bracket, according to the present technology, and depicts one manner in which such a bracket may be positioned against a rafter and a portion of roof sheathing.
Figure 12:
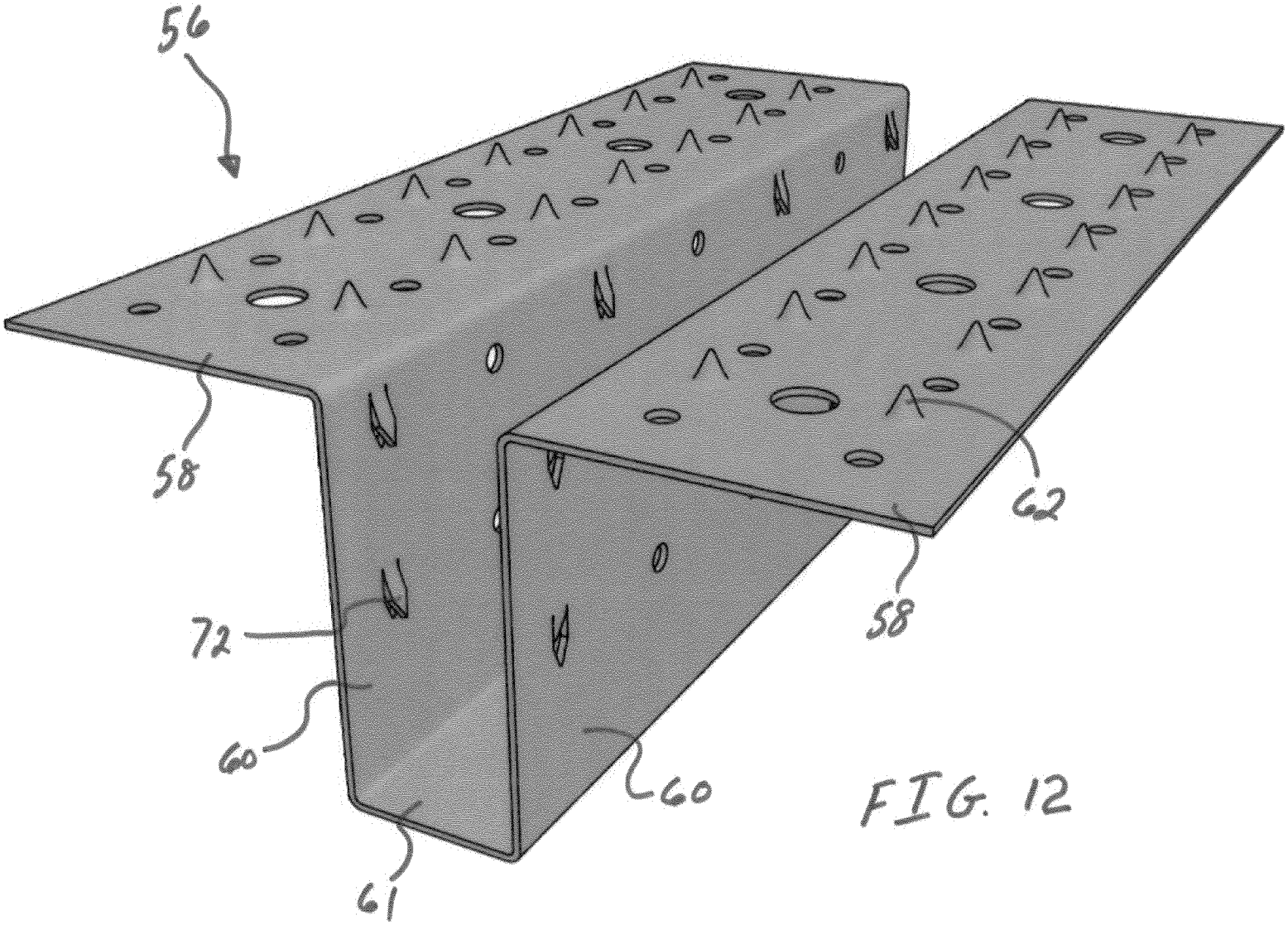
FIG. 12 depicts an upper perspective view of another embodiment of the bracket depicted in FIG. 11.

With reference to FIGS. 11 and 12, an alternate, double bracket 56 may be provided with a pair of first generally planar sections 58, disposed in a co-planar, laterally spaced-apart relationship with one another. The double bracket 56 will include a U-shaped center section that includes a pair of a second generally planar sections 60 that are positioned to be in a generally parallel, spaced-apart relationship with one another. The U-shaped center section further includes a connector section 61 that extends between distal end portions of the second planar sections. In many respects, the double bracket is formed to resemble a pair of oppositely faced brackets 16 that are simply coupled to one another by the connector section 61. The bracket 56 is formed using uniform construction, whereby the bracket 56 is bent at angles to form the previously described orientations between the first and second planar sections. As with the bracket 16, a plurality of laterally spaced protrusions 62 extend outwardly from a first surface 64 of the first planar sections 58. A plurality of laterally spaced adhesive fill apertures 66 and indicator apertures 68 penetrate the first planar sections 58. A plurality of laterally spaced fastener apertures 70 penetrate the second planar sections 58. The width of the connector section 61 is sized to permit the U-shaped center section to slide over the width of standard 2×4 or 2×6 rafters 12 or trusses and then secured into place. The depth of the U-shaped center section is sufficient that it can receive 2×4, 2×6 or even 2×8 rafters 12 or trusses in various embodiments. With reference to FIG. 12, some embodiments of the double bracket 56 include a plurality of barbed tabs 72 that are formed, in the second planar sections 58 of the U-shaped center section. Distal points of the barbed tabs 72 are oriented at an angle toward the connector section 61 to permit the user to push or pound the double bracket 56 onto a rafter 12 or truss so that the double bracket 56 will be temporarily secured in place by the barbed tabs 72 while the user prepares to drive mechanical fasteners 30 through the fastener apertures 70.

Figure 13:
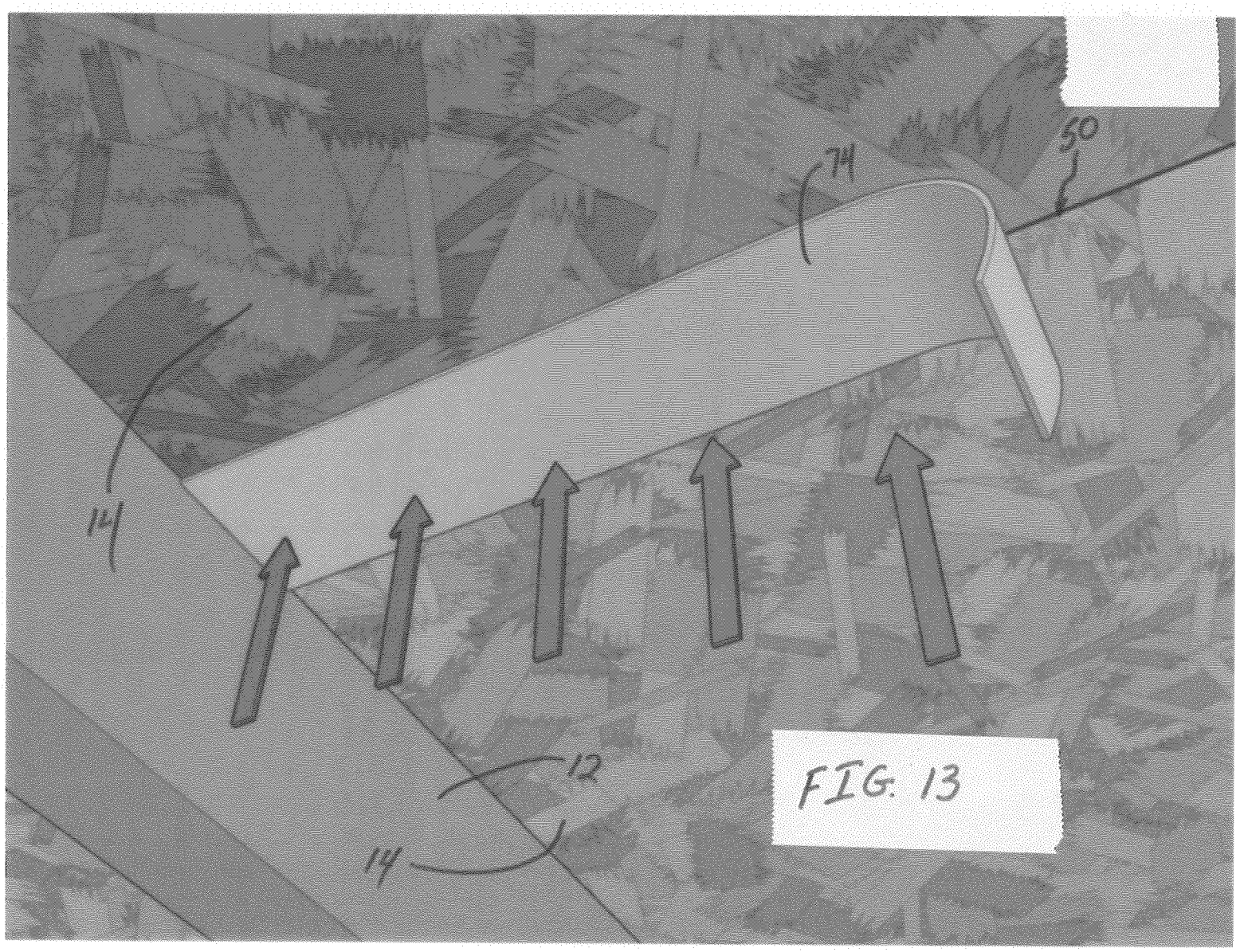
FIG. 13 depicts a perspective view of a section of joint sealing tape that may be used with the bracket of the present technology, when the bracket is used near a joint between sheets of roof sheathing.
Figure 14:
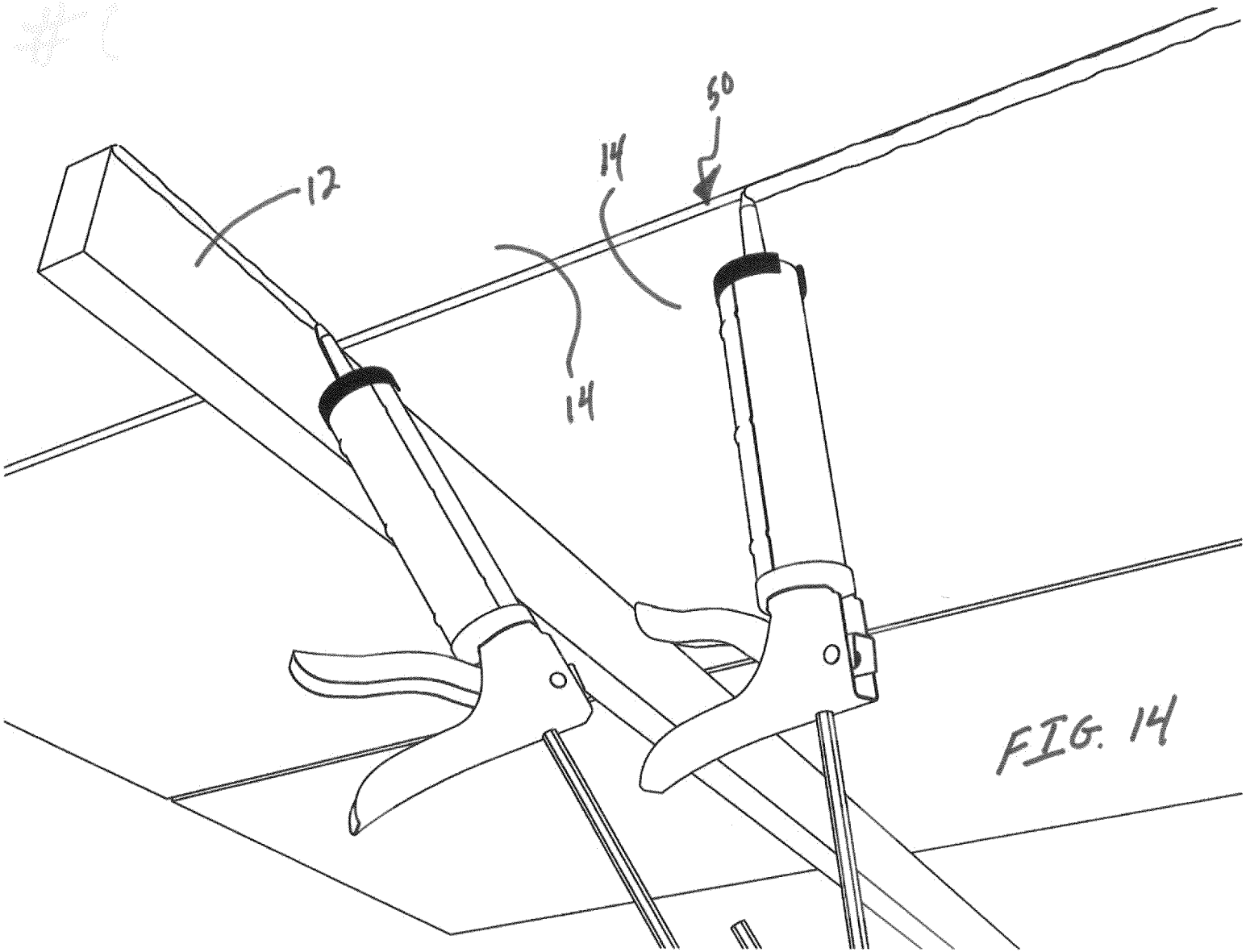
FIG. 14 depicts one manner in which sealant may be applied to joints between roofing components prior to the installation of one or more brackets, according to the present technology.

In various applications, it may be desirable to seal joints 50 between abutting sheets of roof sheathing 14 from water leakage if the tar paper and shingles should be blown off the roof during a storm. With reference to FIG. 13, a section of tape 74, formed from butyl tape material in some embodiments, can be installed over the joint 50. With reference to FIG. 14, the joints 50 may also be sealed with very flexible liquid-applied sealants as well. The preferable type of sealant for this application is one that is extremely flexible and elastic (not having any particular structural capability) so that it can easily accommodate the inevitable expansion/contraction of the roofing elements without enduring excessive stress at the bond-lines where it contacts the wood components. Such sealants or tapes would typically be installed prior to the installation of the brackets 16 and/or 56 and the adhesive 32.

Figure 15:
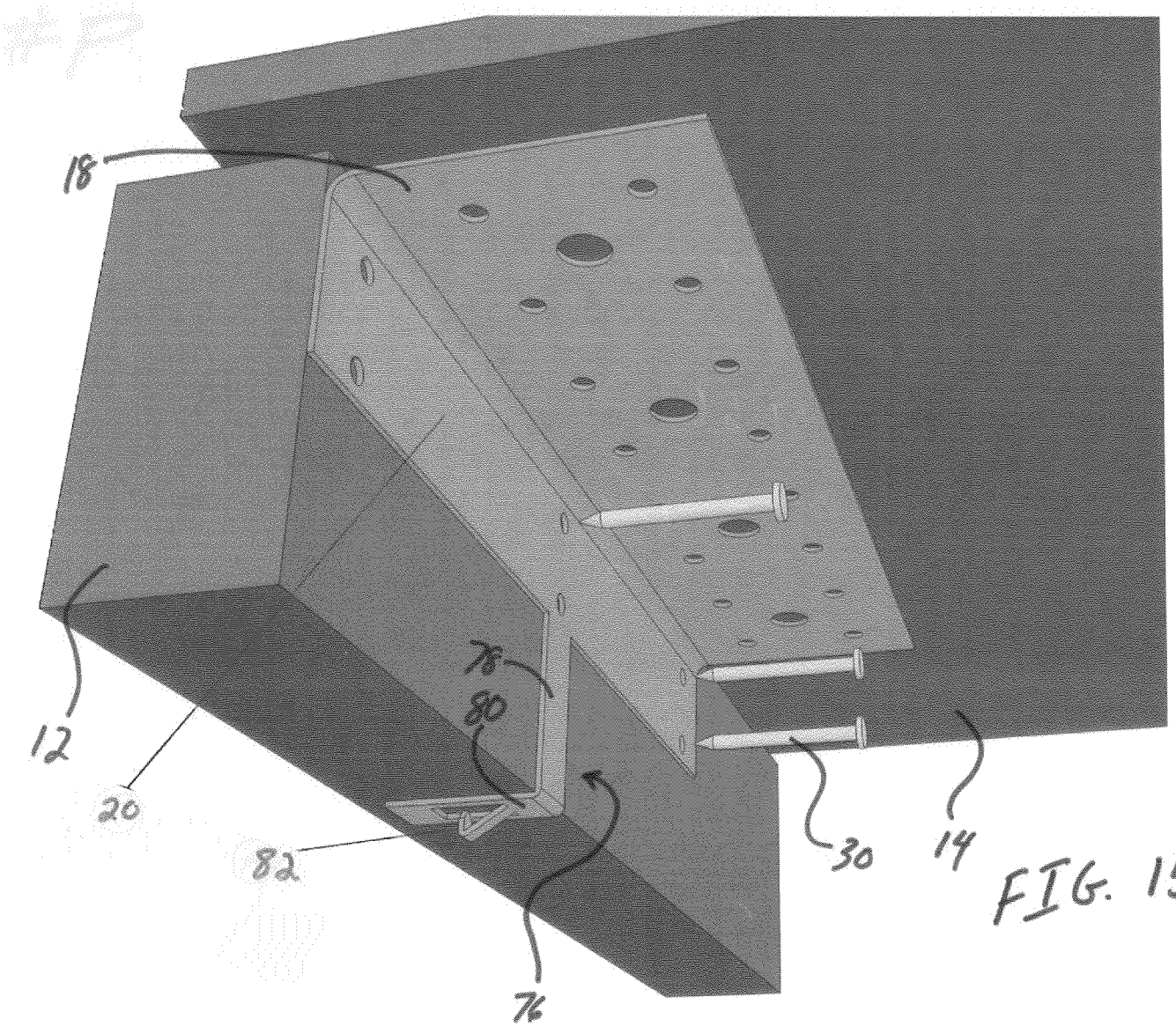
FIG. 15 depicts a lower perspective view of still another embodiment of a bracket, according to the present technology, that may be used to secure roofing components with one another.

With reference to FIG. 15, a self-nailing support arm 76 may be provided to extend from the bracket 16 in order to make installation faster and easier. In some embodiments, the support arm 76 extends from the second planar section 20 such that a first portion 76 of the support arm 76 is positioned against the side of a rafter 12, and a second portion 80 is positioned against the bottom edge of the rafter, when the bracket 16 is in a mounting position. The second portion 80 of the support arm 76 is provided with one or more speed prongs 82 that are positioned to extend away from the support arm at an angle, such that they may be struck with a hammer to set the speed prongs 82 into the rafter 12 and support the bracket 16 until it may be secured with mechanical fasteners 30 and adhesive 32.

With reference to FIG. 16A, a cross section of a rafter 12 and a pair of opposing sheets of roof sheathing 14 are depicted as they interact with the present system 10, in at least one embodiment. In such an arrangement, the sheets of roof sheathing 14 are resting on, and supposed to be firmly attached to, the rafter 12. A normal joint 50 is depicted between the sheets of roof sheathing. Typically, the joint 50 is a fractional-inch gap that is supposed to be left between the sheets of roof sheathing 14 when they are installed so that there is room for typical expansion and contraction during the service life of the roof. A bracket 16 and layer of adhesive 32 are shown coupled with the rafter 12 and one sheet of roof sheathing, using the methods described in greater detail above. The gap 44 that exists between the first surface 24 of the bracket and underside of the roof sheathing 14 allows the flexible adhesive 32 to flex without placing excessive shear stress on the opposing bond-lines of the adhesive 32 in response to the unstoppable expansion and contraction of the constantly heating and cooling roof sheathing 14. Without such a gap 44, the shear forces that would act at the bond-lines could very easily, over time, lead to weakening of the adhesive bond to one or both surfaces or cause cohesive failure of the flexible adhesive 32, leading ultimately to failure when severely stressed in a high wind event. FIG. 16B depicts an example where one sheet of roof sheathing shifts toward the adjacent sheet of roof sheathing, tightening the joint 50. As depicted, however, the layer of flexible adhesive 32 responds, within the gap 44, by deforming but not shearing.

Although the system has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A system for securing at least one rafter with a portion of roof sheathing; the system comprising: a bracket having first and second generally planar sections that are perpendicularly oriented with respect m one another, whereby the bracket is bent at an angle, between the first and second planar sections, at or approximating ninety degrees; a plurality of laterally spaced, rigid protrusions extend outwardly from a first surface of the first planar section and define a fill gap that extends between the first planar section and a height equal to distal ends of the protrusions; the first surface of the first planar section facing away from the second planar section; a plurality of laterally spaced adhesive fill apertures penetrating the first planar section and in open fluid communication with the fill gap; and a plurality of laterally spaced fastener apertures penetrating the second planar section; whereby when installed the protrusions are positioned to simultaneously engage a planar surface and position the fill gap between the first surface of the first planar section and the planar surface, the fill gap configured to receive an adhesive.

2. The system of claim 1 further comprising:

a plurality of laterally spaced indicator apertures penetrating the first planar section; the plurality of indicator apertures being laterally spaced from the adhesive fill apertures.

3. The system of claim 2 further comprising:

a plurality of mechanical fasteners, each passed at least partially through the fastener apertures and into the at least one rafter, whereby the bracket is mechanically secured to the at least one rafter in a position that engages the plurality of protrusions extending from the first planar section with the portion of roof sheathing.

4. The system of claim 3 further comprising:

a layer of adhesive material disposed between the sheathing and the first surface of the first planar section of the bracket, whereby the sheathing and the first planar section of the bracket are secured with one another; at least a portion of the layer of adhesive material being visible from a second surface of the first planar section, through at least one of the plurality of indicator apertures.

5. The system of claim 3 further comprising:

at least one gusset coupled with both the first planar section and the second planar section, whereby distal edge portions of the first and second planar sections resist movement toward one another.

6. The system of claim 3 further comprising:

a first gusset coupled with first end portions of both the first planar section and the second planar section and a second gusset coupled with second end portions of both the first planar section and the second planar section, whereby distal edge portions of the first and second planar sections resist movement toward one another.

7. The system of claim 3, wherein the bracket further comprises:

third and fourth generally planar sections that are perpendicularly oriented with respect to one another, whereby the bracket is bent at an angle, between the third and fourth planar sections, at or approximating ninety degrees;

a plurality of laterally spaced protrusions extend outwardly from a first surface of the third planar section; the first surface of the third planar section facing away from the fourth planar section;

a plurality of laterally spaced adhesive fill apertures penetrating the third planar section; and a connector section that extends between distal end portions of the second and fourth planar sections.

8. The system of claim 7 wherein the connector section is shaped to position the second and fourth planar sections in generally a parallel, spaced-apart relationship with one another.

9. The system of claim 8 wherein the second and fourth planar sections are spaced approximately 1.5 inches apart from one another.

10. The system of claim 1, further comprising:

an adhesive dispensing device, having a nozzle in open communication with a volume of adhesive; the nozzle having a distal end portion that is shaped to closely approximate a shape of at least one of the adhesive fill apertures.

11. The system of claim 10 wherein the distal end portion of the nozzle of the adhesive dispensing device is shaped to have an annular collar that extends from the distal end portion of the nozzle; the collar being sized to approximate dimensions of an adhesive fill aperture.

12. The system of claim 1, further comprising:

an adhesive dispensing device, having a nozzle in open communication with a volume of adhesive;

a cutting guide having open opposite end portions and an open central cavity that extends between the opposite end portions; the opposite end portions each being sized to permit a portion of the nozzle to penetrate the open opposite end portions and leave a portion of the nozzle protruding from the cutting guide.

13. A system for securing at least one rafter with a portion of roof sheathing; the system comprising:

a bracket having first and second generally planar sections that are perpendicularly oriented with respect to one another, whereby the bracket is bent at an angle, between the first and second planar sections, at or approximating ninety degrees; a plurality of laterally spaced protrusions extend outwardly from a first surface of the first planar section; the first surface of the first planar section facing away from the second planar section; a plurality of laterally spaced adhesive fill apertures penetrating the first planar section; a plurality of laterally spaced fastener apertures penetrating the second planar section;

an adhesive dispensing device, having a nozzle in open communication with a volume of adhesive;

a cutting guide having open opposite end portions and an open central cavity that extends between the opposite end portions; the opposite end portions each being sized to permit a portion of the nozzle to penetrate the open opposite end portions and leave a portion of the nozzle protruding from the cutting guide; the cutting guide including a pair of opposing support arms that extend outwardly from side portions of the cutting guide; the support arms being slightly curved as they project radially from the cutting guide and shaped to receive a user's fingers.

14. The system of claim 1, wherein the bracket further comprises:

a pointed projection extending outwardly from a leading edge of the first planar section of the bracket.

15. The system of claim 14, wherein the projection extends from a center portion of the leading edge of the first planar section of the bracket.

16. The system of claim 1, wherein the bracket further comprises:

a support arm that extends from the second planar section of the bracket; the support arm including a first portion that is positioned against the side of a rafter and a second portion is positioned against the bottom edge of the rafter, when the bracket is in a mounting position.

17. The system of claim 16, wherein the second portion of the support arm includes one or more speed prongs that are positioned to extend away from the support arm at an angle.

18. A method for securing at least one rafter with a portion of roof sheathing; the method comprising:

providing a bracket having first and second generally planar sections that are perpendicularly oriented with respect to one another, whereby the bracket is bent at an angle, between the first and second planar sections, at or approximating ninety degrees; a plurality of laterally spaced, rigid protrusions extend outwardly from a first surface of the first planar section and define a fill gap that extends between the first planar section and a height equal to distal ends of the protrusions; the first surface of the first planar section facing away from the second planar section; a plurality of laterally spaced adhesive fill apertures penetrating the first planar section and being in open fluid communication with the fill gap; a plurality of laterally spaced fastener apertures penetrating the second planar section; the plurality of fastener apertures being smaller than the adhesive fill apertures;

positioning the bracket so that the plurality of protrusions extending from the first planar section engage a portion of sheathing and the second planar section is positioned against the at least one rafter; whereby the protrusions are positioned to simultaneously engage a the portion of the sheathing and position the fill gap between the first surface of the first planar section and the portion of sheathing;

securing a plurality of mechanical fasteners at least partially through at least some of the fastener apertures and into the at least one rafter; and disposing a volume of adhesive through at least one of the plurality of adhesive fill apertures in the first planar section, such that a layer of adhesive is formed within the fill gap between the sheathing and the first surface of the first planar section of the bracket, whereby the sheathing and the first planar section of the bracket are secured with one another.

19. The method of claim 18 wherein the bracket further includes a plurality of laterally spaced indicator apertures penetrating the first planar section; the plurality of indicator apertures being laterally spaced from the adhesive fill apertures; and disposing a volume of adhesive through at least one of the plurality of adhesive fill apertures until the layer of adhesive is visible through at least one of the plurality of indicator apertures.

20. The method of claim 18 wherein the bracket is further provided with at least one gusset coupled with both the first planar section and the second planar section, whereby distal edge portions of the first and second planar sections resist movement toward one another.

21. The method of claim 18 wherein the bracket is further provided with: third and fourth generally planar sections that are perpendicularly oriented with respect to one another, whereby the bracket is bent at an angle, between the third and fourth planar sections, at or approximating ninety degrees; a plurality of laterally spaced protrusions extend outwardly from a first surface of the third planar section; the first surface of the third planar section facing away from the fourth planar section; a plurality of laterally spaced adhesive fill apertures penetrating the third planar section; and a connector section that extends between distal end portions of the second and fourth planar sections; the method further comprising:

positioning the bracket so that the plurality of protrusions extending from the first planar section and the third planar section engage a portion of sheathing and the second and fourth planar sections are positioned against opposite sides of the at least one rafter, prior to the step of securing a plurality of mechanical fasteners at least partially through at least some of the fastener apertures and into the at least one rafter.

22. The method of claim 21 further comprising:

disposing a volume of adhesive through at least one of the plurality of adhesive fill apertures in the third planar section, such that a layer of adhesive is formed between the sheathing and the first surface of the first planar section of the bracket, whereby the sheathing and the third planar section of the bracket are secured with one another.

* * * * *